United States Patent [19]

Böttger et al.

[11] Patent Number: 4,903,737

[45] Date of Patent: Feb. 27, 1990

[54] PRODUCING A MULTI-PLY FABRIC ON A LOOM HAVING AUXILIARY END REEDS

[75] Inventors: Wolfgang Böttger, Ködnitz; Kurt Biedermann, Kulmbach, both of Fed. Rep. of Germany

[73] Assignee: Vorwerk & Co. Interholding GmbH, Fed. Rep. of Germany

[21] Appl. No.: 132,954

[22] PCT Filed: Mar. 11, 1987

[86] PCT No.: PCT/DE87/00105

§ 371 Date: Nov. 4, 1987

§ 102(e) Date: Nov. 4, 1987

[87] PCT Pub. No.: WO87/05638

PCT Pub. Date: Sep. 24, 1987

[30] Foreign Application Priority Data

Mar. 12, 1986 [DE] Fed. Rep. of Germany ..... 3608136

[51] Int. Cl.[4] ..... D03D 49/68; D03D 11/00

[52] U.S. Cl. ..... 139/190; 139/188 R; 139/192; 139/411

[58] Field of Search ..... 139/188 R, 192, 190, 139/430, 434, 411, 412, 435, 420 R, 420 A, 420 C

[56] References Cited

U.S. PATENT DOCUMENTS 808,976 1/1906 Dornan ..... 139/412
4,036,265 7/1977 Malásek et al. ..... 139/190
4,078,586 3/1978 Porter et al. ..... 139/434
4,256,148 3/1981 Scharling ..... 139/450
4,320,160 3/1982 Nishimura et al. ..... 139/420 R
4,379,735 4/1983 MacBean ..... 139/411 X

FOREIGN PATENT DOCUMENTS 0056351 7/1982 European Pat. Off. .
2066308 7/1981 United Kingdom .

*Primary Examiner*—Andrew M. Falik
*Attorney, Agent, or Firm*—Watson, Cole, Grindle & Watson

[57] ABSTRACT

A fabric which contains warp threads made of a delicate material is produced on a loom which includes a main reed and auxiliary end reeds at opposite ends of the main reed and which are independently operable with respect to the main reed. The warp threads made of delicate material are extended through the main reed and warp threads of a more robust material are extended through the auxiliary end reeds. As each filler (weft) thread is inserted in a shed the auxiliary end reeds are moved to beat the associated portions of the weft threads. Only after a plurality of weft threads have been inserted is the main reed moved to beat the associated portion of the weft threads, thereby reducing the frequency of movement between the dents of the main reed and the delicate warp threads and thereby reducing frictional destruction thereof.

4 Claims, 3 Drawing Sheets

FIG.2
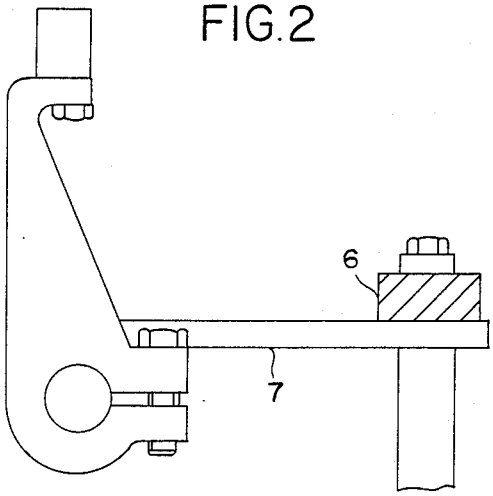
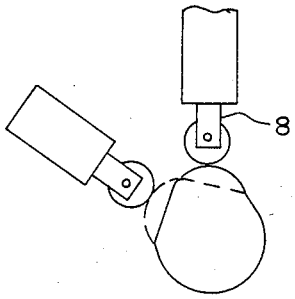
FIG.3

PRODUCING A MULTI-PLY FABRIC ON A LOOM HAVING AUXILIARY END REEDS

BACKGROUND OF THE INVENTION

1. Field of the Invention

This invention relates to a method for the production of fabrics, and more especially to the production of multi-ply fabrics, wherein the fabrics are made completely, or at least predominantly, from extremely delicate technical grade fibers such as carbon fibers, glass fibers or the like. The invention furthermore relates to a loom used to make such fabrics and to the fabrics themselves.

2. The Prior Art

British Pat. No. 2,066,308 describes three-dimensional fabrics made of carbon fibers or glass fibers. There has also been proposed a method for weaving carbon fibers wherein impacts are avoided so as to take into account their extreme brittleness, which is caused by their temperature coefficient of near zero.

Furthermore, European Pat. No. 00 56 351 describes a sheet-like fabric consisting of high-strength material, such as metal fibers, carbon fibers, aramide fibers or mixtures thereof. This sheet fabric is made into a particular shape.

In known systems the result produced has been unsatisfactory because after each filler thread has been inserted into the shed in a conventional loom it has been beaten. In this regard, the dents of the reed rub along and damage the warp threads both during forward and backward motion thereof. In the case of high or very high filler thread counts, there is a proportionality between the respective stroke of the reed, the warp, the filler thread count and the stroke of the sley.

In order to reduce rubbing damage to the delicate warp material, it has been proposed to weave post-twisted warp material or warp material with fibers wrapped around the warp material. However, this results in a reduction in relative strength to the entire fabric, which in many cases is not acceptable.

The object of the present invention is to avoid the above-mentioned disadvantages and to devise a method and an apparatus for creating a fabric whose delicate warp threads have not been impaired during manufacture, even when there is a high filler thread count.

SUMMARY OF THE INVENTION

According to the invention the warp threads of delicate material are mounted on a loom having a main reed and at least one filler (weft) thread is inserted in each shed provided in the fabric without beating, and only after a plurality of filler threads have been inserted is the main reed of the loom moved to beat the filler threads. In this way, frictional contact between the main reed and the delicate warp threads is reduced, thereby improving the quality of the produced fabric. Preferably, the fabric is produced on a loom which has independently operable auxiliary end reeds at opposite ends of the main reed, and the delicate warp threads are mounted on the loom to extend through the main reed and warp threads of a more robust material are mounted on the loom to extend through the auxiliary end reeds. One or more filler (weft) threads are inserted in each shed formed in the delicate threads and the robust threads, and as each filler thread is inserted the auxiliary end reeds are moved to beat the portions of the weft filler threads associated therewith. However, only after a plurality of filler threads have been inserted in one or more sheds and beaten is the main reed moved to beat the portions of the weft filler threads associated therewith, thereby greatly reducing rubbing contact of the main reed against the delicate warp threads that extend therethrough. The edges of the produced fabric containing the robust warp threads (selvedge) can be subsequently cutoff.

The method and apparatus in accordance with the invention offers the advantage that delicate yarns of the type mentioned may be woven into fabrics with appropriate weaves so as to have filler thread counts of 20 to over 150 per cm and so that the production of technical grade fabrics with a three-dimensional structure (multi-ply fabrics) and a very dense arrangement of the filler and warp threads becomes possible. Even in the case of a correspondingly high number of filler threads, the friction of the reed dents on the warp threads may be so substantially reduced that damage to the fabric is avoided. This is especially important with delicate materials used for the warp ends so that, as has proved to be the case, it is especially important that a reduction in strength due to damage to the individual hairs of the thread is avoided. It is more especially in the case of multi-ply fabrics that this leads to an optimum product. If such a fabric is woven with marginal zones whose warp threads are less delicate and whose filler threads are beaten up after each insertion action, the result will be an intermediate product which is quite satisfactory as regards freedom from damage in which the marginal (selvedge) zones may be cut off with minimum loss and the center multi-ply part may be further used.

The invention will be better understood from the attached drawings taken in conjunction with the following discussion

BRIEF DESCRIPTION OF THE DRAWINGS

FIG. 2 shows a side view of a part of the loom of FIG. 1, showing the means for positioning and arresting the motion of the main reed holder.

FIG. 3 shows a part of the loom thereof adjacent to the limit switch control.

DETAILED DESCRIPTION OF THE PREFERRED EMBODIMENT

Figure 1:
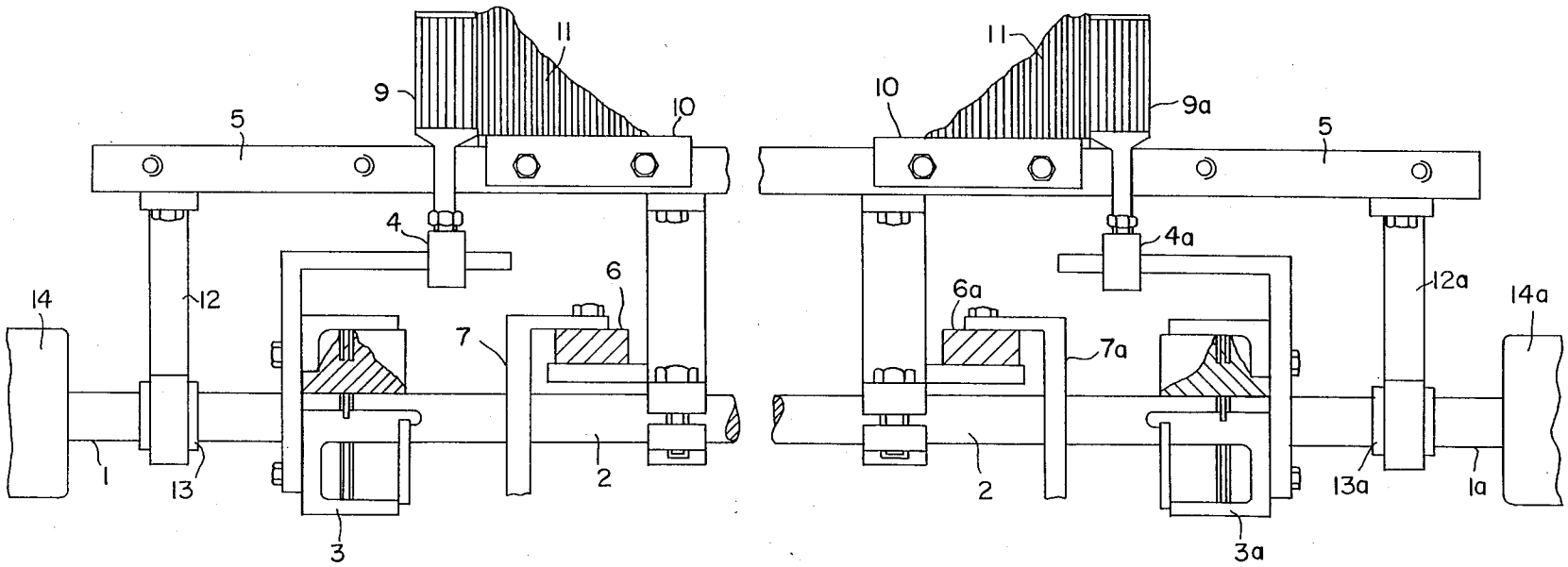
FIG. 1 shows an end view of a portion of a loom constructed in accordance with the present invention.
Figure 4:
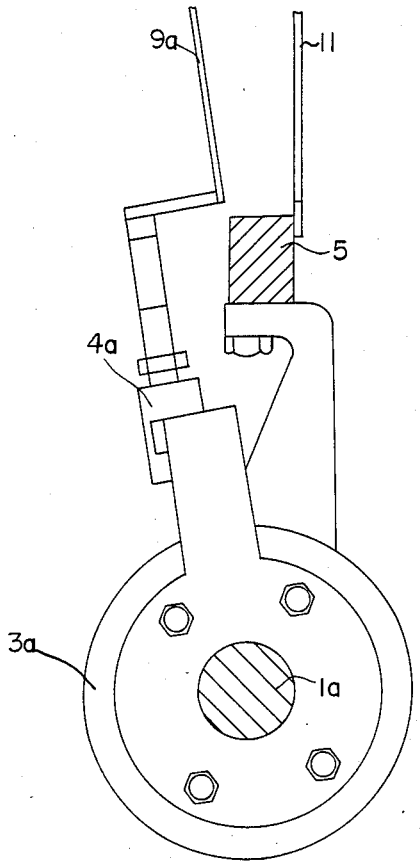
FIG. 4 schematically depicts a fabric being produced according to the present invention.

As shown in FIG. 1, the permanent connections in the form of shaft couplings between the transmission shafts 1, 1*a* and the main reed driving shaft 2 of a loom have been replaced by clutches 3, 3*a*, the operation of which are switchably controlled by conventional means, e.g., a perforated dobby card or another commercially conventional color select device (not shown) wherein a hole in the dobby card causes actuation of the clutch and a beat of the reed (after filler thread insertion) and no hole causes no clutch action and no reed movement.

Since in any case the transmission shafts 1, 1*a* (driven by motors 14, 14*a*) produce the intermittent motion for the sley 5 and thus the main reed holder 10 and the supported main reed 11 independently of the motion of the auxiliary end reeds 9, 9*a*, the two outer sley supports 12, 12*a* are provided with bushes 13, 13*a* so that they are not used for driving the main reed but only for supporting the sley 5.

The auxiliary end reed holders 4, 4a are screwed on the gear tooth clutches 3, 3a adjacent to the left hand and right hand drive motors 14, 14a, which take part in the constantly occurring intermittent motion of the transmission shafts 1, 1a. These holders support the auxiliary end reeds 9, 9a which have a breadth corresponding to the breadth of the fabric selvedge.

The auxiliary end reeds, which are positioned directly to the left and right of the main reed 11, perform the beat up of the filler threads at the right and left hand fabric edges after filler thread insertion. The warp threads of the fabric selvedge are of a robust material.

This arrangement serves to ensure that each filler thread remains about 1 to 3 cm short of the edge of the woven fabric along the length of the main reed if there is no beat up by the main reed.

In accordance with the weave design selected it is thus possible for a plurality of filler threads to be inserted which are jointly beaten up as a group of filler threads after actuation of the gear tooth clutches, with one stroke of the main reed against the edge of the fabric. By suitable operation of the position switch of the color selector (not illustrated here) by way of the limit switch 8—see FIG. 3—it is possible to ensure that the actuation and declutching of the gear tooth clutches is only possible when the main and auxiliary end reeds are stationary in the rearmost position.

The precise positioning and the locking of the reed holder with the gear tooth clutches in the declutched setting is achieved by the electric retaining magnets 6, 6a with the setting plates 7, 7a—see FIGS. 1 and 2. In this case the electric control circuit (not shown) is so designed that the retainer magnets and the gear tooth clutches operate in synchronism.

The periodic beating up by the main reed is controlled to match the selected weave. In particular, this method is suitable for the production of multi-ply fabrics which are so designed that periodically several shedding motions take place only downwards or upwards.

The object of providing the most gentle treatment possible for the warp material during weaving is more effectively achieved if the number of beat ups of the reeds is as small as possible in relation to the number of filler threads inserted.

The number of the filler threads to be beaten up simultaneously onto the edge of the fabric as a group of threads depends on the weave and may be at least 2 and up to more than 10 filler threads as a maximum.

Without a beat up it is in each case possible to insert as many filler threads as there are shedding operations without any cross over of the warp threads.

This occurs:

(1) more especially in the case of multi-ply fabrics, in which the filler threads are inserted in a plurality of planes, the shedding motion only taking place downwards or upwards, and (2) on the insertion of two or more filler threads in an uninterrupted succession into the same shed.

For shedding with crossing warp threads beat up has to take place.

It has been discovered that the features of the finished fabric, which it possesses owing to the fact that lateral marginal zones are beaten up after each shuttle motion whereas the middle part is only beaten up after a filler thread group of a certain size, more particularly in the case of technical grades of fabric, do not interfere with their use. For adaptation to certain applications or for optimizing the ratio of volume to strength it is possible after weaving for the marginal zones having normal but less delicate warp threads to be cut off for the full breadth or for only part of the breadth.

We claim:

1. A method of producing a fabric which has warp and weft threads, said warp threads being made of a delicate material and said weft threads being present in an amount of at least 20 weft threads per cm of warp threads, said method comprising the steps of (1) mounting warp threads made of a delicate material on a loom having a main reed, (2) forming a shed between said warp threads on said loom, (3) inserting without beating a plurality of weft threads in said shed, (4) beating together said plurality of weft threads with said main reed of said loom, and (5) repeating steps (2), (3) and (4).

2. A method of producing a fabric which has warp and weft threads, said warp threads being made of a delicate material and said weft threads being present in an amount of at least 20 weft threads per cm of warp threads, said method comprising the steps of (1) mounting warp threads made of a delicate material on a loom having a main reed, (2) forming a first shed between said warp threads on said loom, (3) inserting without beating a weft thread in said first shed, (4) forming a second shed between said warp threads on said loom, (5) inserting without beating a weft thread in said second shed, (6) beating together said weft threads with said main reed, and (7) repeating steps (2), (3), (4), (5), and (6).

3. A method of producing a fabric which has warp and weft threads, said warp threads being made of a delicate material and said weft threads being present in an amount of at least 20 weft threads per cm of warp threads, said method comprising the steps of (1) mounting a first set of warp threads made of a delicate material on a loom having a main reed and first and second auxiliary end reeds on opposite sides of said main reed so that said first set of warp threads extend through said main reed, (2) mounting a second set of warp threads made of a robust material on said loom so as to extend through said first auxiliary end reed, (3) mounting a third set of warp threads made of a robust material on said loom so as to extend through said second auxiliary end reed, (4) forming a shed between said first, second and third sets of warp threads, (5) inserting a weft thread in said shed, (6) moving said first and second auxiliary end reeds to beat associated portions of said weft thread, (7) repeating steps (4), (5) and (6) at least one time, and (8) moving said main reed to beat an associated portion of said weft threads.

4. In a loom for producing fabrics from delicate materials, said loom including a main reed having opposite ends, first and second transmission shafts, and a main reed driving shaft, the improvement wherein said loom includes first and second auxiliary end reeds respectively positioned adjacent said opposite ends of said main reed, and first and second clutches respectively connected between said first and second transmission shafts and said main reed driving shaft, said first and second clutches being respectively connected to said first and second auxiliary end reeds to simultaneously move said first and second auxiliary end reeds independently of said main reed.

* * * * *